US011241033B2

(12) United States Patent
Fischer

(10) Patent No.: US 11,241,033 B2
(45) Date of Patent: Feb. 8, 2022

(54) METHOD FOR APPLYING REGISTER MARKS TO WRAPPING PAPER FOR SMOKING ARTICLES

(71) Applicant: DELFORTGROUP AG, Traun (AT)

(72) Inventor: Daniel Fischer, Innsbruck (AT)

(73) Assignee: delfortgroup AG, Traun (AT)

( * ) Notice: Subject to any disclaimer, the term of this patent is extended or adjusted under 35 U.S.C. 154(b) by 105 days.

(21) Appl. No.: 16/643,499

(22) PCT Filed: Jul. 10, 2018

(86) PCT No.: PCT/EP2018/068645
§ 371 (c)(1),
(2) Date: Feb. 28, 2020

(87) PCT Pub. No.: WO2019/042639
PCT Pub. Date: Mar. 7, 2019

(65) Prior Publication Data

US 2020/0187553 A1 Jun. 18, 2020

(30) Foreign Application Priority Data

Aug. 29, 2017 (DE) ..... 10 2017 119 819.9

(51) Int. Cl.
*A24C 5/00* (2020.01)
*A24C 5/60* (2006.01)

(52) U.S. Cl.
CPC ..... *A24C 5/601* (2013.01); *A24C 5/007* (2013.01)

(58) Field of Classification Search
CPC ..... A24C 5/00; A24C 5/005; A24C 5/007; A24C 5/3412; A24C 5/601; A24D 1/025;
(Continued)

(56) References Cited

U.S. PATENT DOCUMENTS 3,688,620 A 9/1972 Harris, Jr.
2002/0185141 A1* 12/2002 Heide ..... A24C 5/601 131/281

(Continued)

FOREIGN PATENT DOCUMENTS

DE 102012209544 A1 12/2013
DE 102012106154 A1 1/2014

(Continued)

OTHER PUBLICATIONS

European Patent Office, Examination Report, Application No. 18739534.8, dated Apr. 25, 2019, 9 pages.

(Continued)

*Primary Examiner* — Michael H. Wilson
*Assistant Examiner* — Stephanie Lynn Moore
(74) *Attorney, Agent, or Firm* — Sunstein LLP

(57) ABSTRACT

The invention relates to a method for marking a wrapping paper for smoking articles, comprising the following steps: (A) providing a wrapping paper for smoking articles, and (B) producing register marks on the wrapping paper by treating the surface of the wrapping paper with laser radiation having an energy density y in J-m-2, to which the following applies: y=k·x, whereby x is the enthalpy of combustion per volume of the wrapping paper in $J \cdot m^{-2} \cdot \mu m^{-1}$, and k is at least −8 μm and at most −1 μm.

41 Claims, 4 Drawing Sheets

(58) Field of Classification Search
CPC ..... A24D 1/027; B31F 1/07; B31F 2201/072; B31F 2201/0743; B31F 2201/0779; B31F 2201/0797
See application file for complete search history.

(56) References Cited

U.S. PATENT DOCUMENTS

| | | | |
|---|---|---|---|
| 2004/0118418 | A1 | 6/2004 | Hancock et al. |
| 2015/0114585 | A1 | 4/2015 | Boegli |
| 2015/0164132 | A1 | 6/2015 | Eitzinger et al. |

FOREIGN PATENT DOCUMENTS

| | | | |
|---|---|---|---|
| EP | 2671714 | A1 | 12/2013 |
| OA | 07663 | | 5/1985 |

OTHER PUBLICATIONS

International Bureau of WIPO, Notification of Transmittal of Translation of the International Preliminary Report on Patentability, Application No. PCT/EP2018/068645, dated Mar. 12, 2020, 8 pages.
International Searching Authority/EPO, International Search Report and Written Opinion of the International Searching Authority, Application No. PCT/EP2018/068645, dated Oct. 26, 2018, 12 pages (with English translation of the International Search Report).

* cited by examiner

METHOD FOR APPLYING REGISTER MARKS TO WRAPPING PAPER FOR SMOKING ARTICLES

CROSS-REFERENCE TO RELATED APPLICATIONS

This application is the national phase entry of international patent application no. PCT/EP2018/068645 filed Jul. 10, 2018, which claims priority to German patent application no. 10 2017 119 819.9 filed Aug. 29, 2017, the disclosures of which are incorporated herein by reference in their entirety.

FIELD OF THE INVENTION

The invention relates to a method for applying register marks to a wrapping paper for smoking articles, so that the influence of the register marks on the taste of a smoking article manufactured from the wrapping paper is minimized as much as possible, by adding no or almost no substances to the wrapping paper, which are not also produced during smoking of the smoking article.

BACKGROUND AND PRIOR ART

A smoking article comprises a smokable material and a wrapping paper, which wraps the smokable material and thereby forms a typically cylindrical rod. Usually the smokable material is tobacco or another material which generates an aerosol upon application of heat, and the wrapping paper is a cigarette paper. The smoking article can be a conventional cigarette, in which the tobacco is burnt, but also a smoking article, in which the smokable material is only heated and an aerosol is released thereby. In many cases, the smoking article also comprises a filter, which can filter components of the aerosol and is wrapped by a filter wrapping paper, and a tipping paper, which connects the filter and the rod to each other.

For some smoking articles the wrapping paper has repeating structures in the longitudinal direction of the rod. These structures can be purely optical features such as printing, water marks or also functional features such as bands to control the ignition propensity of the smoking article ("LIP"), a variable composition of the wrapping paper in the longitudinal direction of the smoking article, in particular with respect to the burning additives, or any other features which may be visible or invisible.

For such smoking articles, there is a need for the structures to be at a defined position on the smoking article. In common processes for manufacturing smoking articles, a continuous rod of smokable material is wrapped by the wrapping paper and is later cut into short pieces of nominally identical length. The position of the cut thereby is a random result of the requirement that the pieces should all should be of equal length as far as possible. The position of structures on the wrapping paper does not play a role, so that the structures are then located in a random position on the smoking article.

Some machines for the manufacture of smoking articles are equipped with sensors which can detect structures on the wrapping paper and can synchronize cutting of the continuous rod with the structures such that the structures are on a nominally fixed position on the smoking article. To that end, however, the structures have to be detectable by means of sensors at the usual processing speeds of such machines. If this is not the case, that is, if the structures cannot be detected with economically reasonable effort or at sufficiently high speed, it is an option to print marks, so-called register marks, on the wrapping paper, which are located in a fixed position relative to the structures and can be detected easily and reliably by a sensor. The cutting of the continuous rod is then synchronized with these printed register marks.

It is known in the prior art to print register marks on paper. This is mostly done for multi-color printing machines, for which the prints in the different colors need to be correctly positioned relative to each other. The printing of such register marks on wrapping paper for smoking articles, however, is problematic, because the substances used in printing inks are often not permitted in wrapping papers for smoking articles. In addition, the printing inks and the solvents used during printing can have an influence on the taste of the smoking article, in particular during the first puff. Such an influence can even exist, if the printing ink itself is neither burnt nor heated during use of the smoking article.

In some cases, lasers are also used to apply register marks to paper, wherein a laser beam burns the paper in a small area and thus causes a dark discoloration at a defined position. Such methods are, for example, disclosed in WO98/35096, WO 2007/122284 or WO 2011/026693. There, however, certain pigments are provided in the paper or in coatings on the paper, in order to obtain good marking by a controlled color change, which is often not possible for wrapping papers for smoking articles because of the legal requirements regarding their components.

Even without such pigments or coatings, the goal of methods according to the prior art is generally to produce a register mark which is as visible and detectable as possible without perforating the paper.

In contrast to printing, however, no new substances are applied to the wrapping paper by the laser, but combustion and pyrolysis products are still generated that remain on the wrapping paper. Thus, even when a laser is used to apply register marks to wrapping papers for smoking articles, new substances are present which can influence the taste of a smoking article manufactured from this wrapping paper. Furthermore, the application of register marks to wrapping papers is a special problem, because these papers are comparatively thin and can easily be accidentally perforated, and often contain burn additives which influence the thermal degradation of the wrapping paper.

A negative influence on the taste of a smoking article caused by treatment with a laser is known, for example, from filter cigarettes, for which a perforation track in the circumferential direction in the area of the filter is produced by means of a laser. Although the laser perforates the tipping paper and the filter wrapping paper as intended, it also penetrates into the filter material so that evaporation and combustion products of the filter material remain in the filter and are perceived as irritating by the smoker during the first puff.

Thus, there is a need for a method to generate register marks on the wrapping paper of a smoking article so that the influence on the taste of a smoking article manufactured from this wrapping paper is as small as possible.

SUMMARY OF THE INVENTION

It is the objective of the present invention to provide a method which allows register marks to be produced on the wrapping paper for a smoking article such that the influence of these register marks on the taste of a smoking article manufactured from the wrapping paper is as small as possible.

This objective is achieved by a process according to claim 1. Further advantageous embodiments are provided in the dependent claims.

The inventors have found that, in contrast to the prior art in which the visibility of the register marks is in the foreground, the influence on the taste of the smoking article can be minimized by ensuring that if material is added, the added material are merely substances which are generated during smoking of the smoking article and thus have no negative effect on the taste.

Thus, the method according to the invention for marking a wrapping paper for smoking articles comprises the steps of (A) providing a wrapping paper for smoking articles, wherein the wrapping paper comprises pulp fibers, (B) producing register marks on the wrapping paper by at least the following step (B.3) treating the surface of the wrapping paper by laser radiation with an energy density y in $J \cdot m^{-2}$, for which $y=k \cdot x$, wherein x is the enthalpy of combustion per volume of the wrapping paper in $J \cdot m^{-2}\ \mu m^{-1}$, and wherein k is at least −8 μm, preferably at least −7 μm and particularly preferably at least −6.5 μm, and at most −1 μm, preferably at most −2 μm and particularly preferably −2.5 μm, and wherein either in a step (C), repeating structures are produced on the wrapping paper so that each structure is located at a fixed distance in the machine direction relative to at least one register mark, or in step (A), a wrapping paper is provided which has repeating structures in the machine direction and the register marks in step (B) are produced such that each register mark is located at a fixed distance in the machine direction relative to at least one structure. At least one section of the register mark has an extension in the machine direction of at least 0.01 mm.

In the present disclosure, a "fixed" distance is in particular a pre-determined or known distance, which allows the position of the structure to be deduced from the position of the register mark.

Step (B) of producing register marks on the wrapping paper may further comprise a step (B.1) of removing material from the wrapping paper Step (B.1) is based on the consideration that by removing material from the wrapping paper, in particular over the whole thickness of the wrapping paper, preferably by die cutting, perforating or cutting, modifications are produced in the wrapping paper which can be detected as register marks by suitable sensors. Particularly preferably, the modification is at least one opening in the wrapping paper. Thereby, material is only removed from the wrapping paper and thus any influence on the taste of the smoking article manufactured from the wrapping paper is avoided. However, when designing the openings in the wrapping paper, the requirements of the subsequent processing steps regarding the strength have to be particularly considered.

Step (B) of producing register marks on the wrapping paper may further comprise a step (B.2) of mechanically modifying the wrapping paper. The method in step (B.2) is based on the consideration that by mechanical treatment of the wrapping paper, in particular by embossing or compressing, register marks can be produced on the wrapping paper which can be detected by suitable sensors. In general, by embossing or compressing, the wrapping paper will become more transparent in such treated areas and appears darker against a suitable background, so that detection is possible. Also in this regard, no substances are added to the wrapping paper and any influence on the taste of the smoking article manufactured from the wrapping paper is avoided. Also, when designing the register marks, the tensile properties of the wrapping paper need to be considered, but less so than when openings are produced.

The method according to the invention in step (B.3) is based on the consideration that by treatment of the surface of the wrapping paper with laser radiation, components of the wrapping paper are changed in their color by pyrolysis or combustion such that these changes can be easily detected with suitable sensors. In general, such treated areas of the wrapping paper will appear darker than the wrapping paper.

During the treatment with laser radiation, however, the composition of the wrapping paper is modified, that is, new substances are added. In the context of the invention, it is thus ensured that these new substances do not substantially differ in type and amount from those which are generated during smoking of a smoking article manufactured from the wrapping paper.

This further inventive step is based on the consideration that during smoking or heating of the smoking article, pyrolysis or combustion products are generated in the wrapping paper which the smoker will inhale during smoking and which contribute to the taste of the smoking article. During pyrolysis or combustion of the wrapping paper, the enthalpy of combustion is released, which in part is released to the environment, for example by heat radiation, heat conduction or convection, but in part also maintains the smoldering process in the wrapping paper by heat conduction. However, during smoking of the smoking article, the wrapping paper is only incompletely burned, so that not all of the enthalpy of combustion is released; this can, for example, be measured in a calorimeter. On the other hand, the smokable material can also provide energy to the wrapping paper.

Regarding the energy introduced by the laser, it has to be considered that by treatment with the laser, only the surface is thermally affected, while during smoking of the smoking article, the entire mass of the wrapping paper is thermally degraded. Furthermore, the duration of the thermal effect of the laser is much shorter than during smoking of the smoking article. In addition, not all of the laser radiation is absorbed by the wrapping paper, but rather, a portion is reflected and a portion penetrates through the wrapping paper.

Considering all these complex aspects, the energy density of the laser can be selected such that a similar amount of energy is provided to the wrapping paper on the area to be marked up to a certain depth of the wrapping paper, as would be provided to the same volume during smoking of the smoking article from the region around this area. It could then be expected that similar substances in similar relative amounts to each other would be generated as would be the case during smoking of the smoking article, and thus an undesirable influence on the taste of the smoking article would be avoided as far as possible. Investigations by the inventor have shown that this goal can be achieved if an energy density y (in $J \cdot m^{-2}$) for the laser radiation is selected for which $y=k \cdot x$ holds, wherein x is the enthalpy of combustion per volume of the wrapping paper in $J \cdot m^{-2}\ \mu m^{-1}$, and wherein k is at least −8 μm, and preferably at least −7 μm and particularly preferably at least −6.5 μm and at most −1 μm, preferably at most −2 μm and particularly preferably at most −2.5 μm.

In particularly preferred embodiments of the method, $-5.0\ \mu m \leq k \leq -4.0\ \mu m$ holds.

It should be noted that the inventive concept is in contrast to the teaching in the prior art, according to which the skilled person would be inclined to provide little energy by a laser to materials which release energy under thermal loads in order to prevent ignition or perforation of the material. In contrast thereto, according to the teaching of this invention, a higher energy density of the laser radiation should be selected in order to release more energy, which is reflected in the proportionality constant k, so that, as far as possible, the same substances are generated as during pyrolysis or combustion of the wrapping paper on the smoking article.

In preferred embodiments for each of the steps (B.1), (B.2) and (B.3) it holds that, if at all, only substances which are already present in the wrapping paper in step (A) or which are generated during smoking of a smoking article manufactured from the wrapping paper are added to the wrapping paper.

FIG. 1 shows the principle of the invention. On the wrapping paper 1 with the machine direction indicated by arrow 3 and the cross direction indicated by arrow 4, structures 7 are present which are either already present on the wrapping paper 1 provided in step (A) or which are applied in accordance with step (C). To synchronize the paper, register marks 2 are produced on the wrapping paper so that each register mark 2 is located at a fixed distance 8 relative to each one of the structures 7.

The wrapping paper for smoking articles provided in step (A) of the method according to the invention comprises pulp fibers. The pulp fibers are required because they provide the necessary strength to the wrapping paper. The pulp fibers are preferably wood pulp fibers, particularly preferably from long-fiber pulp, such as, for example, from spruce, pine or larch, or from short-fiber pulp, such as, for example, from birch, beech or eucalyptus and mixtures thereof. In other preferred embodiments, the pulp fibers are partially or entirely from other plants such as flax, hemp, sisal, jute, abaca, cotton, esparto grass or mixtures thereof. Basically, there are no restrictions regarding the selection of pulp fibers so that the wrapping paper can, for example, also contain pulp fibers from regenerated cellulose such as lyocell fibers, viscose fibers or modal fibers. Legal regulations regarding the components of a wrapping paper for smoking articles need to be observed, of course.

The wrapping paper preferably contains at least 50% by weight, particularly preferably at least 60% by weight and highly particularly preferably at least 70% by weight pulp fibers and preferably at most 100% by weight, particularly preferably at most 80% by weight pulp fibers. The percentages relate to the entire mass of the wrapping paper.

The wrapping paper can contain filler material. The filler material is preferably an oxide, hydroxide, carbonate, hydrogen carbonate or silicate or a mixture thereof. Calcium carbonate is particularly preferred, in particular precipitated calcium carbonate. Further filler materials that can preferably be used in wrapping papers for smoking articles are magnesium oxide, magnesium hydroxide, aluminum hydroxide, titanium dioxide, talc and kaolin or mixtures thereof. However, special filler materials can be also used which irreversibly change their color under the effect of laser radiation and thus contribute to the visibility of the mark, for example, iron oxides. Here again, the legal regulations regarding the components of the wrapping paper for smoking articles have to be observed.

The wrapping paper provided in step (A) of the method preferably contains filler in an amount of at least 10% by weight, in particular at least 20% by weight and preferably at most 50% by weight, particularly preferably at most 40% by weight and highly particularly preferably at most 35% by weight. The percentages relate to the entire mass of the wrapping paper. In an alternative embodiment, the wrapping paper for smoking articles contains no filler. These alternative embodiments are particularly preferred when the wrapping paper is to be used for manually produced smoking articles ("Roll-Your-Own").

In particular with respect to use on smoking articles, where the smokable material is burnt, for example for conventional cigarettes, the wrapping paper can contain at least one burn additive, which increases or reduces the smoldering speed of the smoking article or can improve the appearance of the ash of the burnt tobacco together with the burnt wrapping paper. Since burn additives often influence the thermal degradation of the wrapping paper and thus the enthalpy of combustion, they also play a role in the selection of the energy density of the laser radiation in step (B.3).

The wrapping paper thus preferably comprises one or more burn additives selected from the group consisting of citrates, malates, tartrates, acetates, nitrates, succinates, fumarates, gluconates, gylcolates, lactates, oxalates, salicylates, α-hydroxy caprylates, phosphates, chlorides and hydrogen carbonates, preferably selected from the group consisting of trisodium citrate, tripotassium citrate and mixtures thereof. The wrapping paper can contain substances selected from the group consisting of sodium chloride, magnesium chloride, calcium chloride, monoammonium phosphate, diammonium phosphate, boric acid and mixtures thereof as burn-retarding substances.

The burn additives content in the wrapping paper is preferably at least 0.5% by weight, particularly preferably at least 0.7% by weight and highly particularly preferably at least 1.0% by weight and/or at most 70.0% by weight, particularly preferably at most 50.0% by weight and highly particularly preferably at most 30.0% by weight. In an alternative embodiment, the wrapping paper for smoking articles does not contain any burn additives. This embodiment is particularly preferred when the wrapping paper is to be used for manually produced smoking articles ("Roll-Your-Own").

The wrapping paper can contain further components that are known in the prior art. These include, for example, colorants, pigments, flavors or inorganic fibers such as glass fibers. The use of such substances, however, is restricted by legal regulations in many countries.

The basis weight of the wrapping paper is of importance for the method according to the invention, because it essentially determines the mechanical strength of the wrapping paper and the design of step (B). The wrapping paper for the method according to the invention has in preferred embodiments a basis weight between 10 $g/m^2$ and 100 $g/m^2$, preferably between 20 $g/m^2$ and 50 $g/m^2$ and particularly preferably between 25 $g/m^2$ and 35 $g/m^2$. The basis weight of the wrapping paper can be determined in accordance with ISO 536:2012.

For the same reason, the thickness of the wrapping paper also plays a role in the method according to the invention. The thickness of the wrapping paper is in preferred embodiments between 15 μm and 100 μm, preferably between 30 μm and 60 μm and highly particularly preferably between 40 μm and 50 μm. The thickness of the wrapping paper can be measured on a single layer in accordance with ISO534:2011.

For the method according to the invention, it is important that the wrapping paper contains regularly repeating structures in the machine direction, so that it is necessary to apply register marks at a fixed position relative to each structure, which can be used in later processing steps to synchronize the processing steps with the movement of the wrapping paper.

As in step (C), in a variation of the method according to the invention, these structures can be applied to the wrapping paper after application of the register marks, or in an alternative variation of the method according to the invention, they can already be present on the wrapping paper provided in step (A).

The invention is not limited to a certain type of structures. These can, for example, be printed, embossed or die-cut features on the wrapping paper, which should appear in a fixed position on a smoking article manufactured from this wrapping paper. They can also be water marks, wire marks or verge lines. The type of the structures is not limited to optically perceptible features thereby, but can also comprise functional features. This includes, for example, bands applied to the wrapping paper, which serve for self-extinguishing of a smoking article manufactured therefrom, or perforations, which serve for the dilution of the aerosol flowing through the smoking article, as described in WO 2011/120687. In addition, the structures can be such that the composition of the wrapping paper changes regularly in the machine direction, in particular with respect to the content of burn additives, as described in WO 2014/202319. Preferably, the method according to the invention can be used when the structures are not detectable by sensors or can only be detected with great effort.

The production of the structures on the wrapping paper in step (C) or in a step preceding step (A) can thus preferably comprise printing, embossing, perforating, die-cutting, soaking, impregnating, coating or spraying.

The structures are thereby repeated regularly in the machine direction, wherein the term machine direction should be understood to mean the direction in which the wrapping paper moves in that further processing step which requires synchronization with the structures on the wrapping paper. In most cases this will be the same direction as that in which the wrapping paper can be produced on a paper machine according to the prior art, i.e. the "machine direction" of the wrapping paper. In preferred embodiments, the wrapping paper is in the shape of an elongated web and the "machine direction" corresponds to the longitudinal direction of this web.

Step (B.1) can preferably be designed such that material is removed over the entire thickness of the wrapping paper and thus at least one opening is produced in the wrapping paper. Particularly preferably, the at least one opening is produced by die-cutting, perforating or cutting. Less preferred, but also within the scope of the method according to the invention, is the superficial removal of material from the wrapping paper, for example by grinding or scratching, so that the transparency of the wrapping paper is increased in this area, but no opening is produced.

As long as the step (B.1) is carried out by perforating or cutting, mechanical perforation or cutting tools or a laser can preferably be used; particularly preferably, this step is carried out by a $CO_2$ laser.

Regarding the shape of the register mark produced in step (B.1), in preferred embodiments, care is taken that the outermost borders of the register mark in the cross direction do not have radii of curvature that are too small. In the present disclosure, the "cross direction" is the direction orthogonal to the machine direction. Preferably, the radius of curvature of the outermost border in the cross direction is at least 0.1 mm, preferably at least 0.2 mm and particularly preferably at least 0.5 mm. This means that stress peaks at these outermost borders can be effectively reduced during tensile loading in the machine direction, as such stress peaks can easily lead to tearing of the wrapping paper during processing and can reduce the productivity. As the outermost borders of the register mark in the cross direction can also be straight lines, the radius of curvature can be arbitrarily high.

This fact is shown in FIG. 2 by way of exemplary explanation. FIG. 2 shows a wrapping paper 1 with register marks 2, which as an example are designed as elliptical openings in the wrapping paper. The machine direction of the wrapping paper is indicated by arrow 3, while the cross direction, indicated by arrow 4, is essentially orthogonal thereto. In a magnified view 6 of the register mark 2, the outermost border 5 of the register mark 2 in the cross direction is shown magnified, as well as the radius of curvature of the outermost border 5 in the cross direction designated by R.

In a particularly preferred embodiment, the register mark is a circular opening with a diameter of at least 0.3 mm and at most 2.0 mm, preferably of at least 0.5 mm and at most 1.5 mm.

The step (B.2) can preferably be designed such that the mechanical treatment is embossing or compressing of the wrapping paper. In this regard, the wrapping paper is compressed in an area, so that the transparency is locally increased. In front of a dark background, the register mark can then be detected by sensors as a dark area compared to the untreated wrapping paper. In the preferred embodiment, embossing or compression of the wrapping paper can be accomplished by mechanical pressure between two rolls with a corresponding pattern, which create a register mark on the wrapping paper.

The line load for embossing the wrapping paper is of importance to the method according to the invention. Preferably, the line load for embossing the wrapping paper for smoking articles is 70 N/mm to 130 N/mm, preferably 80 N/mm to 120 N/mm and particularly preferably 90 N/mm to 115 N/mm. At this line load, embossing is obtained, which can be detected without any problems by optical sensors but which does not substantially reduce the tensile strength of the wrapping paper.

The moisture content of the paper is also of importance for the embossing result in the method according to the invention. Preferably, embossing is carried out at an increased moisture content of the paper of 5% by weight to 10% by weight and particularly preferably of 7% by weight to 9% by weight, wherein these percentages relate to the mass of the wrapping paper. At this increased moisture content, embossing delivers a more visible register mark, which can then be automatically detected more easily.

A further preferred embodiment of this process step is the production of register marks in the area of the press section of the paper machine during manufacture of the wrapping paper, that is on the not yet "completely finished" wrapping paper. Here, an embossing process can be employed, which is very similar to the embossing process for the finished wrapping paper described above, except that the moisture content of the wrapping paper in the press section is higher than for a completely finished wrapping paper. In particular, here again, a cylinder with a corresponding pattern can be used. An alternative embodiment of this process step comprises the production of register marks by corresponding devices on the wire of the paper machine during manufacture of the wrapping paper, in the same way as water marks can be produced on paper.

Step (B.3) of the method according to the invention can preferably be designed such that it comprises the following sub-steps:

(B3.1) selection of an energy density of the laser radiation based on the enthalpy of combustion per volume of the wrapping paper, (B3.2) marking the wrapping paper by use of laser radiation with the energy density selected in step (B3.1), so that regularly repeating marks in the machine direction are produced on the wrapping paper.

For the selection of the energy density of the laser radiation in step (B3.1) of the method according to the invention based on the enthalpy of combustion per volume of the wrapping paper, it is advantageous, but not necessary, if the enthalpy of combustion of the wrapping paper is known.

The enthalpy of combustion of the wrapping paper can, for example, be determined with a calorimeter, in particular with a reaction calorimeter. In many cases, however, the components of the wrapping paper are substances of which the enthalpy of combustion is known with sufficient precision, so that the enthalpy of combustion can also be calculated from the known composition of the wrapping paper. Such exemplary calculations are described further below.

In a preferred embodiment of the step (B3.1) according to the invention, it is then no longer necessary to numerically determine the enthalpy of combustion itself, but instead, a suitable energy density for the laser radiation can be determined directly from the composition of the wrapping paper and other properties, in particular the thickness and the basis weight. In this regard, knowledge of the enthalpy of combustion is advantageous as an intermediate quantity, but it is not necessary. In any case, step (B3.1) of the preferred method according to the invention should also include methods in which the enthalpy of combustion is not explicitly determined, but in which variables are used for the selection of the energy density that essentially influence the enthalpy of combustion. These quantities are, in particular, the substances used in the wrapping paper, their amount, the basis weight or the thickness of the wrapping paper.

The selection of the energy density by using the enthalpy of combustion in step (B3.1) of the preferred method according to the invention can preferably comprise the use of a mathematical function $y=f(x)$, wherein the input variable x is the enthalpy of combustion per volume of the wrapping paper and wherein the output variable y is the energy density of the laser radiation. In preferred embodiments, this function is a monotonically decreasing function in the relevant interval $x\in[x_0, x_1]$, that is $df(x)/dx\leq 0$ for all $x\in[x_0, x_1]$, particularly preferably a strictly monotonically decreasing function, $df(x)/dx<0$ for all $x\in[x_0, x_1]$, and highly particularly preferably a linear function $y=k\cdot x+d$ with $k<0$, in particular a proportionality of the form $y=k\cdot x$ with $k<0$. The interval $[x_0, x_1]$ here is of a size such that it contains, as a subset, the interval spanning from the smallest enthalpy of combustion to the greatest enthalpy of combustion, each per volume of the wrapping paper, of those wrapping papers to which the method according to the invention should be applied.

In preferred methods, the selection of the energy density is made using the enthalpy of combustion per volume of the wrapping paper by application of the aforementioned function $y=f(x)$ with $y=k\cdot x$, $k<0$, wherein k is at least −8 μm and preferably at least −7 μm and particularly preferably at least −6.5 μm and at most −1 μm, preferably at most −2 μm and particularly preferably at most −2.5 μm. For k, an interval from −5.0 μm to −4.0 μm is particularly preferred. In the function f(x), the enthalpy of combustion per volume of the wrapping paper has to be input in $J\cdot m^{-2}\cdot\mu m^{-1}$ and the energy density is obtained in $J\cdot m^{-2}$.

The laser radiation used for marking the wrapping paper in step (B.3) of the method according to the invention has one or more wavelengths that are important for the energy density required for the marking. In particular, the wrapping paper should essentially absorb the one or more wavelengths of the laser radiation well. A wavelength of at least 8 μm and at most 12 VIM is preferred, and laser radiation with a wavelength of about 10.6 μm is particularly preferred, which is produced by a $CO_2$ laser. The use of other sources for the laser radiation, however, is equally well possible in the method according to the invention.

The power of the laser radiation can vary over a wide range and, apart from the required energy density, depends primarily on the area that is to be treated with the laser radiation per unit of time. The skilled person will be able to determine a suitable power for the laser. An example for the calculation of the relationship between the energy density and the required power of the laser radiation is provided further below.

The skilled person can select by experience or simply determine by experiments any further parameters which are of importance for the selection of the laser, for example, whether a continuous or pulsed laser beam should be used.

The register marks produced on the wrapping paper in step (B) of the method according to the invention should be designed such that they can be reliably detected by simple optical sensors, in particular those that detect differences in brightness. To that end it is helpful for the register marks to differ significantly from the remaining wrapping paper in their color or whiteness, and for the wrapping paper itself not to contain structures which the sensor could confuse with the register marks. When the register mark is an opening in the wrapping paper, the background in the area of the sensor should be selected to differ in color from the wrapping paper or a transmission sensor (light barrier) should be used. The register marks produced on conventional white wrapping papers in accordance with one of the process steps (B.2) or (B.3) are preferably continuous or discontinuous lines in the cross direction, that is, at least approximately orthogonal to the machine direction, as defined above. Other marking patterns, for example, circles, triangles, squares or other geometrical figures can also be used, however.

Independently of the way of producing them, the extension of the register marks in the machine direction is relevant for the method according to the invention, because their extension is of importance to reliable detection. During the manufacture of smoking articles, the wrapping paper reaches speeds of up to 10 m/s. The register mark should be below the sensor for at least 1 μs in order to ensure reliable detection, so that the register mark has an extension in the machine direction in at least one section thereof of at least 0.01 mm. Preferably, the extension in the machine direction in at least one section of the register mark is at least 0.10 mm and particularly preferably at least 0.20 mm. On the smoking article, the register mark itself should be as invisible as possible. The extension of the register mark in the machine direction should thus be at most 5.00 mm, preferably at most 3.00 mm and particularly preferably at most 1.00 mm. For these preferred extensions, consideration should be given to reducing the tensile strength of the wrapping paper in the machine direction to such a small extent that further processing of the wrapping paper is possible.

For register marks which do not or only insignificantly reduce the mechanical strength of the wrapping paper, such as those register marks which were produced in accordance with process steps (B.2) or (B.3), the register mark can extend in the cross direction over the entire width of the wrapping paper. The minimum extension of the register mark in the cross direction is determined by the ability of the sensor employed to reliably detect the register mark and also depends on how precisely and stably the wrapping paper can be guided under the detection area of the sensor. Preferably, the extension of the register mark in the cross direction is thus at least 0.20 mm, particularly preferably at least 0.50 mm and highly particularly preferably at least 1.00 mm.

As long as the register marks are produced on a wide reel of the wrapping paper, which should subsequently be cut into narrower reels, it makes sense to arrange the register marks in such a way on the wrapping paper that at least one register mark is located on each of the narrow reels in the width direction. In this manner, the register marks can also still be detected in subsequent processing steps on the individual narrow reels.

For register marks which considerably reduce the mechanical strength of the wrapping paper, such as those register marks produced according to process step (B.1) and in particular those register marks which are formed by openings in the wrapping paper, the extension in the cross direction must be selected to be as small as possible. Preferably, the extension of the register mark in the cross direction is at least 0.20 mm, particularly preferably at least 0.50 mm and highly particularly preferably at least 1.0 mm, and preferably at most 5.00 mm and particularly preferably at most 4.00 mm and highly particularly preferably at most 3.00 mm.

As long as the register marks are produced on a wide reel of the wrapping paper, which will subsequently be cut into narrower reels, it makes sense to arrange the register marks in such a way on the wrapping paper that at least one register mark is located on each of the narrow reels in the cross direction. In this manner, the register marks can also still be detected in subsequent processing steps on the individual narrow reels. The extension of the register marks in the cross direction is then preferably at most one third, particularly preferably at most one fifth and highly particularly preferably at most one tenth of the width of the narrow reel.

When cutting such marked, wide reels into narrow reels, it makes sense to apply the register marks and to control the cutting process such that the register marks are not cut through and thus are not located at the edge of the narrow reel.

The register mark can be located on the wrapping paper on any side of the wrapping paper. If the register mark is produced on the wrapping paper, the register mark will be produced on that side of the wrapping paper on which it can be detected more easily in the subsequent processing step. When wrapping papers for smoking articles, this is preferably the side of the wrapping paper which is on the outside of the smoking article. This side of the wrapping paper is preferably the side which is facing away from the wire during manufacture of the wrapping paper, on the paper machine and is called felt side, while the wire side is that side which is facing the wire and typically faces the smokable material on the smoking article.

If the register mark is an opening in the wrapping paper, the opening can be produced from any of the two sides or from both sides.

The position of each register mark is in general arbitrary, as long as it is ensured that all register marks are at an identical and fixed distance in the machine direction relative to at least one structure on the wrapping paper. This distance must be known, so that in the subsequent processing step, the position of the structure on the wrapping paper can be derived from the position of the register mark. Particularly preferably, the position of the register marks relative to the structures on the wrapping paper is selected such that the register marks are not visible during normal use of the smoking article manufactured from the wrapping paper. For filter cigarettes, this can mean that the register marks are located on the wrapping paper such that they are in an area on the filter cigarette in which the tipping paper overlaps the rod of smokable material, so that the register marks on the wrapping paper are covered.

The individual steps (A), (B) and (C) of the method according to the invention can be carried out on a single device or separately on several devices.

As an example, in step (A), the wrapping paper can firstly be manufactured on a conventional paper machine and wound up. On a separate device, the wrapping paper is unwound and the register marks are produced in step (B) on the wrapping paper and the wrapping paper marked thereby is wound up again. On a further device, for example, a printing machine or a coating machine, the structures are applied to the wrapping paper in step (C).

It is also possible and preferred in some applications to carry out the steps (B) and (C) on the same device. For example, the device can be a printing machine or a coating machine, in which firstly, the register marks are produced, step (B), and then the structures are applied in the same device, step (C). In this case, it is advantageous to provide a register control which is known in the art between the marking unit, which carries out step (B), and the device for applying the structures in accordance with step (C). The register control synchronizes the positions of the register marks and the structures to be applied by means of a sensor detecting the register marks. This synchronization can mean that changes in length of the wrapping paper as it runs through the device can be compensated for. Apart from the printing machines, embossing machines, die-cutting machines or perforation machines which are known in the art, a device for applying structures to wrapping papers for smoking articles is also described in WO 2010/124879.

During machine-making of smoking articles, the register marks can be detected by suitable sensors and the typically continuous rod of smokable material, which is wrapped by the wrapping paper, can be cut at a position synchronized with the register marks, so that the structures occupy a fixed position on the smoking article.

For wrapping papers for the manual production of smoking articles, the reel of wrapping paper is cut into small sheets, so that they are suitable for the manual production of smoking articles ("Roll-Your-Own"). The register marks are detected on this machine and cutting into sheets is synchronized with the register marks. In this, the structures are located in a fixed position on the sheet and thus also in a fixed position on the smoking article manufactured from the sheet.

In a variation of the method, in which in step (A), a wrapping paper is provided which already has repeating structures in the machine direction, the steps (A) and (B) are preferably carried out on the same device. This variation thus envisages that the wrapping paper already contains structures and the register marks are added later. In order that the register marks are in a fixed position relative to the structures, it is necessary to detect the structures. For such a method, it would therefore be obvious to detect the structures themselves in the subsequent processing step, instead of producing register marks first and detecting these register marks in the subsequent processing step. In other words, at first glance the production of register marks appears superfluous if the structures have to be detected anyway.

There are cases, however, when the sensors for the detection of the structures are costly and detection is only possible at low speeds, for example when the structures are barely visible or consist of a variation in the composition of the wrapping paper. In these cases, the method can be employed in an advantageous manner.

In many applications for wrapping papers for smoking articles, the wrapping paper exists firstly as a wide reel and for the manufacture of smoking articles is later cut into a plurality of narrower reels, so-called bobbins. In the method according to the invention, the costly detection of the structures and the corresponding marking of the wrapping paper is then carried out on a wide reel at low speed, while on the machines for the manufacture of smoking articles, only comparably simple sensors are needed in order to detect the register marks instead of the structures, whereupon a high production speed can be obtained and costly sensors are avoided. Particularly preferably, the method can be used when the machine for the manufacture of smoking articles is a cigarette machine and the later processing step is cutting of a continuous rod of smokable material, which is wrapped by the wrapping paper.

Of course, arbitrary intermediate steps can be carried out between the individual steps, as are required for the manufacture of the wrapping paper for smoking articles.

DESCRIPTION OF PREFERRED EMBODIMENTS

The method according to the invention will be explained in more detail below by way of preferred exemplary embodiments.

Figure 1:
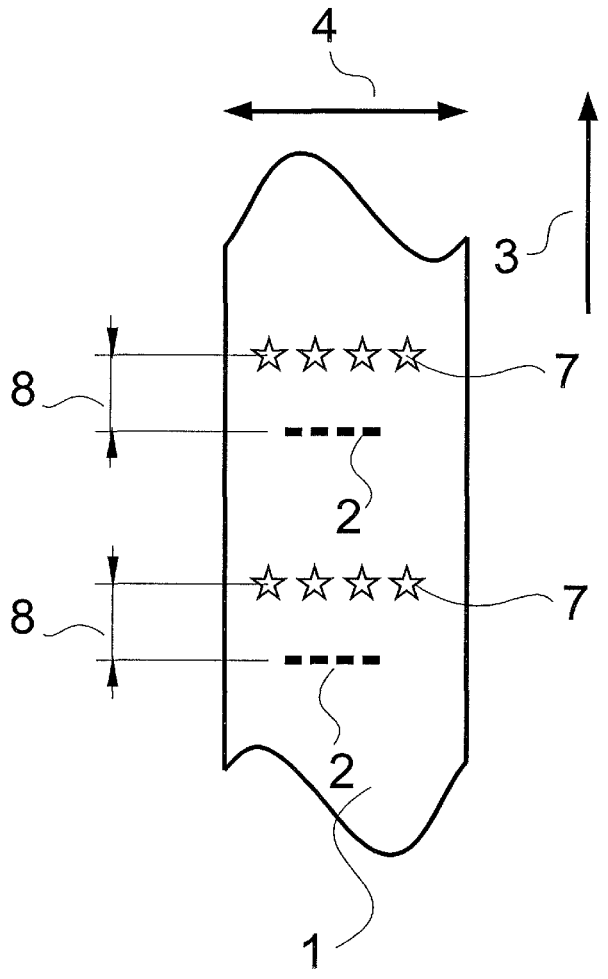
FIG. 1 shows a wrapping paper, to which structures and register marks have been applied.
Figure 2:
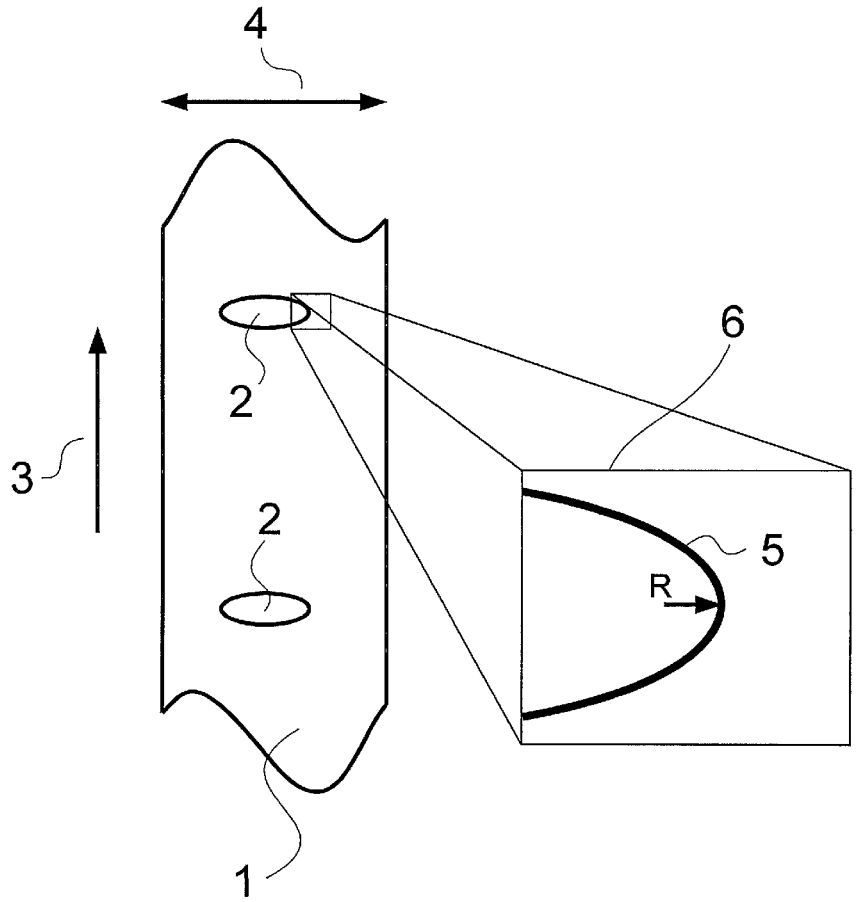
FIG. 2 shows a wrapping paper, on which register marks are formed as openings.
Figure 3:
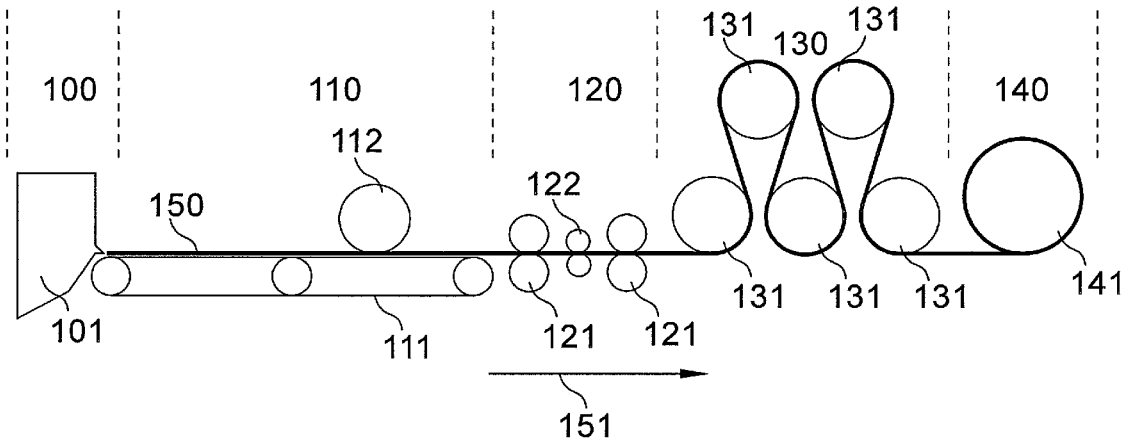
FIG. 3 illustrates the manufacture of wrapping paper with a paper machine, and the potential production of marks in the wire section or press section.

FIG. 3 shows the manufacture of the wrapping paper 150 according to the invention by means of a paper machine running in the machine direction 151. In accordance with exemplary FIG. 3, the paper machine comprises a section 100 of the head box, a wire section 110, a press section 120, a drying section 130 and a winding section 140. From a head box 101, an aqueous fiber suspension or a fiber/filler suspension flows onto a running wire 111, on which a wrapping paper 150 is formed by de-watering. The wrapping paper 150 then runs through a press section 120 in which pressure is exerted on the wrapping paper 150, typically by using felt-covered roll pairs 121, thereby further de-watering the wrapping paper iso. Then the wrapping paper 150 runs through the drying section 130, in which it is contacted with at least one, but preferably more, heated drying cylinders 131 and the water is removed by evaporation, so that the wrapping paper 150 reaches a moisture content of 3% to 10%. Finally, the wrapping paper 150 is wound up on a reel 141.

In order to produce register marks in accordance with step (B.2), a patterned cylinder 112 can, for example, be provided in the wire section 110 of the paper machine, which exerts pressure on the still moist wrapping paper 150 and thereby displaces material in the wrapping paper 150 and produces a pattern of higher transparency. Alternatively and in order to produce register marks in accordance with step (B.2), a pair of rolls 122 can, for example, be provided in the press section 120, which transfers a pattern on the rolls 122 onto the wrapping paper 150 by mechanical pressure. Preferably, the pair of rolls is the last pair of rolls in the press section in the machine direction.

Figure 4:
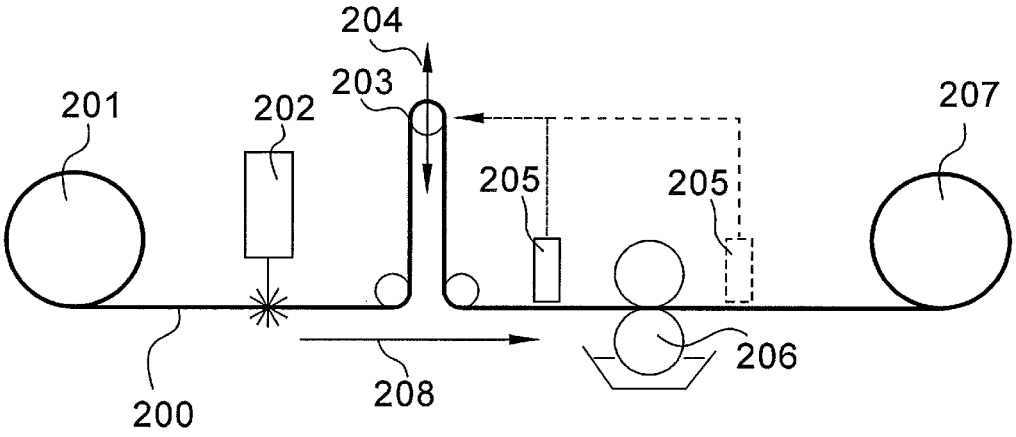
FIG. 4 illustrates a process in which the register marks and the structures on a wrapping paper are formed in the same device.

FIG. 4 shows an exemplary manufacturing process for the wrapping paper according to the invention, in which in step (A) according to the invention, a wrapping paper 200, which does not yet have any structures, is provided on a reel 201 and is running in the machine direction 208. In step (B), register marks are produced on the wrapping paper 200 by means of a marking unit 202. In the embodiment shown, the marking unit 202 is formed by a laser, by means of which laser radiation treats the wrapping paper 200 in a step (B.3). The detection unit 205, for example an optical sensor, detects the register marks produced by the marking unit 202 and acts on a register control such that the structures produced by a device 206 on the wrapping paper 200 are located at a fixed distance from the register marks. In the embodiment shown, the device 206 can, for example, be a printing device, by means of which bands are printed on the wrapping paper 200, which serve for self-extinguishing. The register control can be carried out here by a guide roller 203 which is movable in the direction of the arrow 204, which lengthens or shortens the length of the path between the marking unit 202 and device 206 and thereby positions the register marks and the structures relative to each other. Preferably, the detection unit 205 can also be located behind the device 206, as indicated by dashed lines in FIG. 4, because then the position of the register marks and the structures on the wrapping paper 200 relative to each other can be determined directly and control of the relative position is possible. In a final step, the wrapping paper 200 is wound up on a reel 207.

Figure 5:
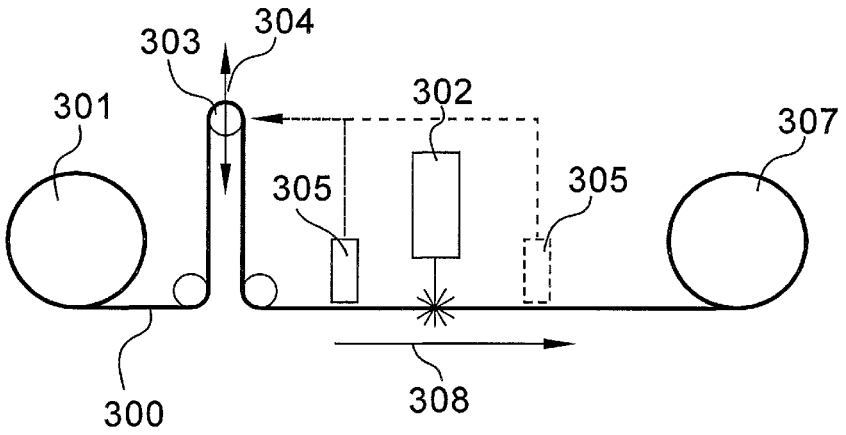
FIG. 5 illustrates a process in which a prepared wrapping paper already has structures and register marks are produced on the wrapping paper such that they are located at a fixed distance in the machine direction relative to the corresponding structures.

FIG. 5 shows an exemplary manufacturing process according to the invention, in which the wrapping paper provided in step (A) already has structures on it. The wrapping paper 300 is provided here on a reel 301 and runs in the machine direction 308 firstly through a register control, which, for example by means of a guide roll 303 that is movable in the direction of arrow 304, can lengthen or shorten the length of the paper web between a roll 301 and a marking unit 302 (in the embodiment shown, again a laser), so that the register marks produced by the marking unit 302 are precisely located at a fixed distance relative to the structures present on the wrapping paper 300. A detection unit 305, which can be arranged before or after the marking unit, thereby detects at least the structures and acts on the position of guide roll 303 such that a fixed distance between the register marks and the structures is generated on the wrapping paper 300. Preferably, the detection unit 305 is located after the marking unit 302, because at this position, the register marks as well as the structures can be detected and their position relative to each other can be determined directly and thus controlled. If the detection unit 305 is located before the marking unit 302, the distance between detection unit 305 and marking unit 302 is preferably as small as possible. Finally, the wrapping paper 300 is wound up on a reel 307.

Figure 6:
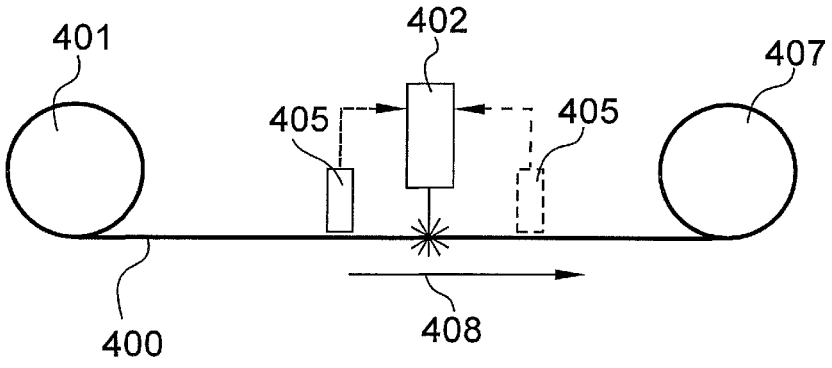
FIG. 6 illustrates a similar process to that of FIG. 5, which is suitable when register marks are to be formed independently of the movement of the wrapping paper.

FIG. 6 shows a further exemplary embodiment of the manufacturing process according to the invention. In a step (A), a wrapping paper 400 is provided which already has structures on it, in the form of a reel 401 and runs through the process in the machine direction 408. A detection unit 405, which is located before or after the marking unit 402, detects the structures and directly controls the marking unit 402 (laser), so that the register marks produced by the marking unit 402 are located at a fixed distance relative to the structures on the wrapping paper 400. This exemplary embodiment is then preferably employed when the production of the register marks by the marking unit 402 can be triggered independently of the movement of the wrapping paper. Preferably, this will be possible by marking with a laser in accordance with step (B.3). The detection unit 405 can also preferably be located after the marking unit 402 so that the position of the register marks and structures relative to each other can be determined directly, and thus control of this position is possible. Finally, the wrapping paper 300 is wound up on a reel 407.

In a first step (A) of the method according to the invention, four different wrapping papers with the properties of Table 1 were provided, wherein apart from pulp fibers, precipitated calcium carbonate as filler material and tripotassium citrate or mixtures of trisodium citrate and tripotassium citrate were used as burn additives. The papers were manufactured on a conventional Fourdrinier machine, as is schematically shown in FIG. 3 in a highly simplified manner.

TABLE 1

Properties of the wrapping papers

| Paper | Basis Weight $g/m^2$ | Thickness µm | | Pulp Fibers | Filler Content | Citrate Content |
|---|---|---|---|---|---|---|
| P1 | 30.0 | 54.0 | % | 62.2 | 36.0 | 1.80 |
| | | | $g/m^2$ | 18.66 | 10.80 | 0.54 |
| P2 | 45.0 | 65.0 | % | 55.0 | 45.0 | 0.00 |
| | | | $g/m^2$ | 24.75 | 20.25 | 0.00 |
| P3 | 25.0 | 43.0 | % | 67.0 | 32.0 | 1.00 |
| | | | $g/m^2$ | 16.75 | 8.00 | 0.25 |
| P4 | 26.0 | 47.0 | % | 70.0 | 29.0 | 1.00 |
| | | | $g/m^2$ | 18.20 | 7.54 | 0.26 |

As an example of the process step (B.1), a reel with a width of 106 mm was cut from each wrapping paper and register marks were produced on a die-cutting device. The register marks were circular openings with a diameter of 0.5 mm. Several such openings were located next to each other in the cross direction, wherein the center of the first opening viewed from the edge in the cross direction was at a distance of 13.25 mm from the edge and the center of each further opening was spaced 26.5 mm from the center of the preceding opening, viewed in the cross direction. The reel was then cut into bobbins each with a width of 26.5 mm, as is typical for the manufacture of cigarettes with a diameter of about 8 mm. Thereby, in the cross direction the openings were located in the center of each bobbin. The repeat rate of the openings in the machine direction was adapted to the specific manufacturing process for the cigarettes. In this specific embodiment, filter cigarettes were subsequently manufactured with a tobacco rod with a length of 54 mm. To this end, the tobacco rod was firstly cut into pieces each with a length of 54 mm. The pieces were separated in the longitudinal direction and a double-length cigarette filter was added between each two of these pieces. A double-width tipping paper was glued around the filter and a part of each of the two tobacco rod pieces, so that a double cigarette was produced, connected at the mouth end. In a final step, the double cigarette was cut in the middle. From this manufacturing process, an arrangement of the openings in the machine direction results in which, starting from the center of the first opening in the machine direction, the next center of an opening was at a distance of 5 mm and then starting again from the first opening, the next but one center was at a distance of 108 mm, corresponding to double the length of the tobacco rod on the cigarette.

By means of this arrangement, the openings are located under the tipping paper, and were thus not visible. This also avoids cutting the openings during the manufacture of the cigarettes.

The openings could be reliably detected by means of a light barrier and further processing of the wrapping paper to cigarettes was trouble-free, which shows that the reduction in the tensile strength was sufficiently low.

As an example of the process step (B.2), a continuous line in the cross direction with a width of 0.25 mm was embossed on each of the wrapping papers. Because of the greater thickness of the wrapping paper P2, a greater force of about 115 N/mm could be used than for the papers P1, P3 and P4, for which the line load for embossing was between 90 N/mm and 100 N/mm. For embossing, a higher moisture content of the wrapping paper of 5% by weight to 10% by weight in relation to the mass of the wrapping paper was selected, because then the embossing is more clearly visible and more easily detectable. As an alternative to the line pattern a dot pattern was also embossed at similar line loads.

The embossed register marks, the line pattern as well as the dot pattern, were easily visible with the naked eye on all wrapping papers, so that there was no doubt that they could also be detected by sensors at higher speeds.

An example of the process step (B.3) in the preferred embodiment comprising the steps (B3.1) and (B3.2) is described below.

In order to determine the energy density of the laser radiation, firstly, the enthalpy of combustion of the papers was estimated. For this purpose, the enthalpy of combustion of cellulose and citric acid are known in accordance with Table 2 and for calcium carbonate, Table 2 shows the enthalpy of the reaction $CaCO_3 \rightarrow CaO + CO_2$.

TABLE 2

Enthalpies for the determination of the enthalpy of combustion

| | Enthalpy kJ/mol | Molar Mass g/mol | Enthalpy kJ/g |
|---|---|---|---|
| Cellulose | −2828 | 162.14 | −17.44 |
| Calcium Carbonate | +178 | 100.08 | +1.78 |
| Citric Acid | −1972 | 192.13 | −10.26 |

From these values, the enthalpy of complete combustion of the wrapping paper can be estimated, by multiplying for all components the mass per unit area present in the wrapping paper by the enthalpy per mass and summing, wherein the citrate content of Table 1 has also been converted into the citric acid content. The enthalpy per unit area thus obtained was divided by the thickness. The results are provided in Table 3.

TABLE 3

Estimated enthalpies of combustion for the wrapping papers

| Paper | Enthalpy of Combustion | $kJ \cdot m^{-2} \cdot \mu m^{-1}$ |
|---|---|---|
| P1 | (−17.44 × 18.7 + 1.78 × 10.8 − 10.26 × 0.37)/54 | −5.75 |
| P2 | (−17.44 × 24.7 + 1.78 × 20.3 − 10.26 × 0.0)/65 | −6.07 |
| P3 | (−17.44 × 16.7 + 1.78 × 8.0 − 10.26 × 0.16)/43 | −6.48 |
| P4 | (−17.44 × 18.2 + 1.78 × 7.5 − 10.26 × 0.19)/47 | −6.51 |

The marking of the papers was carried out with a $CO_2$ laser with a nominal power of 25 W, emitting a continuous laser beam with a wavelength of 90.2 μm to 10.9 μm. The laser was operated at 70% of its nominal power, that is with 17.5 W.

The marking pattern was a continuous line in the cross direction of the wrapping paper with a width of 0.25 mm, which was produced with different speeds of 1 m/s to 7 m/s on the papers P1, P2, P3 and P4. From these technical data, the theoretical energy densities provided in Table 4 resulted by calculation, dividing the laser power (17.5 W) by the speed and the line width. If a function $y=f(x)=k \cdot x$ is taken as a basis for the relationship between the enthalpy of combustion per unit volume of the wrapping paper x in $kJ \cdot m^{-2} \mu m^{-1}$ and the energy density of the laser beam y in $kJ \cdot m^{-2}$, then a proportionality factor k can be calculated for each of the wrapping papers P1 to P4 at each of the different speeds. The results fork are also shown in Table 4.

TABLE 4

Proportionality factor k

| | Energy | Proportionality Factor K [μM] | | | |
|---|---|---|---|---|---|
| Speed m/s | Density $kJ \cdot m^{-2}$ | P1 | P2 | P3 | P4 |
| | | μm | | | |
| 1 | 70.0 | −12.2 | −11.5 | −10.8 | −10.8 |
| 2 | 35.0 | −6.1 | −5.8 | −5.4 | −5.4 |
| 3 | 23.3 | −4.1 | −3.8 | −3.6 | −3.6 |
| 4 | 17.5 | −3.0 | −2.9 | −2.7 | −2.7 |
| 5 | 14.0 | −2.4 | −2.3 | −2.2 | −2.2 |
| 6 | 11.7 | −2.0 | −1.9 | −1.8 | −1.8 |
| 7 | 10.0 | −1.7 | −1.6 | −1.5 | −1.5 |

The wrapping papers were examined with respect to their suitability for the manufacture of smoking articles and their influence on the taste of a smoking article.

In all of the experiments, the register mark was sufficiently strong in order to reliably detect the register mark with a simple sensor on the wrapping paper running in the machine direction, however, at marking speeds of 6 m/s and 7 m/s, they were no longer strong enough for the register mark to be reliably detected on a wrapping paper running at high speed in the machine direction. Thus, k should not exceed the value of −1 μm and should preferably be less than −2 μm.

On the other hand, the energy density was still sufficiently low for none of the wrapping papers to be perforated, so that solely based on the result of the marking, the values for k can also be substantially less than −12 μm.

To investigate the influence on taste, several continuous lines in the cross direction were produced close to each other in the form of a 6 mm wide band on the wrapping paper and filter cigarettes were manufactured therefrom. The lines located close to each other thereby formed a 6 mm wide band in the circumferential direction of the cigarette. An investigation was carried out as to whether a perceptible difference in taste would result during smoking, if during a puff on the cigarette, the glowing cone moved from the untreated wrapping paper into the area of the band. For all of the smoking articles with wrapping papers that were manufactured at a speed of 1 m/s, that is values for k of about −11 μm, a negative influence on the taste was perceptible, while the other smoking articles were unaffected.

Thus, this means that a value for k should preferably not fall below −8 μm, preferably it should not fall below −7 μm and particularly preferably it should not fall below −6.5 μm. For reasons of detectability of the register marks, the value for k should preferably not be greater than −1 μm, particularly preferably not greater than −2 μm, highly particularly preferably not greater than −2.5 μm. The best results regarding visibility of the register mark and taste of the smoking article resulted for marking speeds of 2 m/s to 3 m/s, that is, a value for k of −5.0 μm to −4.0 μm.

Of course, the inclusion of further paper parameters, such as air permeability, transparency or brightness can further fine-tune the function y=f(x).

On a printing machine with corresponding sensors and register control, a logo was printed on the wrapping paper, to confirm that it is possible to produce structures on the wrapping paper which are positioned at a fixed distance in the machine direction to the register register marks, as is provided in step (C) of the method according to the invention. As expected, this was possible without any problems, because the wrapping papers were not substantially changed in their mechanical properties, in particular in their tensile strength, by marking with the laser.

The invention claimed is:

1. Method for marking a wrapping paper for smoking articles, comprising the following steps:

(A) providing a wrapping paper for smoking articles, wherein the wrapping paper comprises pulp fibers, (B) producing register marks on the wrapping paper by means of at least the following step (B.3) treating the surface of the wrapping paper with laser radiation with an energy density y in $J \cdot m^{-2}$, for which $y=k \cdot x$ holds, wherein x is the enthalpy of combustion per volume of the wrapping paper in $J \cdot m^{-2} \cdot \mu m^{-1}$, wherein k is at least −8 μm and at most −1 μm, wherein either in a step (C), regularly repeating structures are produced on the wrapping paper, so that each structure is located at a fixed distance in the machine direction relative to at least one register mark, or a wrapping paper is provided in step (A) which has regularly repeating structures in the machine direction, and the register marks are produced on the wrapping paper in step (B) such that each register mark is located at a fixed distance in the machine direction relative to at least one structure, wherein at least one section of the register mark has an extension in the machine direction of at least 0.01 mm.

2. Method according to claim 1, for which: $-5.0\ \mu m \leq k \leq 4.0\ \mu m$ holds.

3. Method according to claim 1, wherein the pulp fibers are entirely or partially formed by wood pulp fibers from spruce, pine or larch, or from birch, beech or eucalyptus, or mixtures thereof.

4. Method according to claim 1, wherein the pulp fibers are partially or entirely from flax, hemp, sisal, jute, aback cotton, esparto grass or mixtures thereof, and/or wherein the wrapping paper contains pulp fibers from regenerated cellulose.

5. Method according to claim 1, wherein in step (A), a wrapping paper is provided which contains at least 50% by weight of pulp fibers in relation to the total mass of the wrapping paper.

6. Method according to claim 1, wherein a wrapping paper is provided in step (A) which contains a filler, wherein the filler is an oxide, hydroxide, carbonate, hydrogen carbonate or silicate, or a mixture thereof.

7. Method according to claim 6, wherein the filler is entirely or partially formed by calcium carbonate, magnesium oxide, magnesium hydroxide, aluminum hydroxide, titanium dioxide, talc, kaolin, or mixtures thereof, and/or wherein at least a part of the filler is of a type such that it changes its color irreversibly under the action of laser radiation.

8. Method according to claim 6, wherein a wrapping paper is provided in step (A) which contains filler in an amount of at least 10% by weight and at most 50% by weight, each in relation to the total mass of the wrapping paper.

9. Method according to claim 1, wherein a wrapping paper is provided in step (A) which contains at least one burn additive, selected from the group consisting of citrates, malates, tartrates, acetates, nitrates, succinates, fumarates, gulconates, glycolates, lactates, oxalates, salicylates, α-hydroxy caprylates, phosphates, chlorides and hydrogen carbonates and mixtures thereof.

10. Method according to claim 9, wherein the content of burn additives in the wrapping paper provided in step (A) is at least 0.5% by weight and at most 3.0% by weight, each in relation to the mass of the entire wrapping paper.

11. Method according to claim 1, wherein in step (A), a wrapping paper is provided which comprises burn-retarding substances, selected from the group consisting of sodium chloride, magnesium chloride, calcium chloride, monoammonium phosphate, diammonium phosphate, boric acid and mixtures thereof.

12. Method according to claim 1, wherein a wrapping paper is provided in step (A) which has a basis weight of between 20 $g/m^2$ and 50 $g/m^2$.

13. Method according to claim 1, wherein a wrapping paper is provided in step (A) which has a thickness of between 15 μm and 100 μm.

14. Method according to claim 1, wherein the repeating structures are formed by one or more of the following structures:

- printed, embossed or die-cut features on the wrapping paper, which should appear at a fixed position on the smoking article manufactured from this wrapping paper,
- water marks, wire marks or verge lines,
- bands printed on the wrapping paper, which serve for self-extinguishing of a smoking article manufactured therefrom,
- perforations, which serve for dilution of an aerosol flowing through the smoking article,
- regular, local changes in the composition of the wrapping paper in the machine direction.

15. Method according to claim 1, wherein said repeating structures are formed before step (A) or in step (A) in a process which comprises one or more of the steps of printing, embossing, perforating, die-cutting, soaking, impregnating, coating or spraying, or combinations thereof.

16. Method according to claim 1, wherein step (B.3) comprises the following sub-steps:

(B3.1) selecting the energy density of the laser radiation based on the enthalpy of combustion per volume of the wrapping paper, and (B3.2) marking the wrapping paper by using laser radiation with the energy density selected in step (B3.1), so that regularly repeating register marks are produced on the wrapping paper in the machine direction.

17. Method according to claim 16, wherein the enthalpy of combustion of the wrapping paper is determined by measurement with a calorimeter or wherein the enthalpy of combustion of the wrapping paper is calculated or estimated based on information with respect to the type and amount of the components of the wrapping paper and information with respect to the enthalpy of combustion of the individual components.

18. Method according to claim 1, wherein the laser radiation used in step (B.3) has a wavelength of at least 8 μm and at most 12 μm.

19. Method according to claim 18, wherein the laser radiation used in step (B.3) is produced by a $CO_2$ laser.

20. Method according to claim 1, wherein in step (B.3), register marks in the shape of continuous or discontinuous lines are formed which extend at least approximately orthogonally to the machine direction.

21. Method according to claim 1, wherein at least one section of the register mark has an extension in the machine direction of at least 0.10 mm, and wherein the extension of the register marks in the machine direction is at most 3.00 mm.

22. Method according to claim 1, wherein the extension of the register marks, which are produced in step (B.3), orthogonally to the machine direction is at least 0.20 mm.

23. Method according to claim 1, wherein the register marks are produced on a wide reel of the wrapping paper, which is subsequently cut into narrower reels, and wherein the register marks are arranged on the wrapping paper such that in a direction viewed orthogonally to the machine direction, there is at least one register mark on each of the narrow reels, wherein the extension of the register marks in the direction orthogonally to the machine direction is at most one third of the width of the narrow reel, and/or wherein the register marks are arranged and the cutting process is controlled such that the register marks are not cut through and thus are not located at the edge of the narrow reels.

24. Method according to claim 1, wherein the register marks are formed on that side of the wrapping paper which is on the outside of a smoking article to be manufactured therefrom.

25. Method according to claim 1, wherein the position of the register marks relative to the structures on the wrapping paper is selected such that the register marks are not visible during normal use of the smoking article manufactured from the wrapping paper.

26. Method according to claim 25, wherein the smoking article is formed by a filter cigarette and wherein the register marks are positioned on the wrapping paper such that they are in an area on the filter cigarette in which the tipping paper overlaps the rod of smokable material and thereby covers the register marks on the wrapping paper.

27. Method according to claim 1, wherein in step (A), the wrapping paper is firstly manufactured on a conventional paper machine and wound up, the wrapping paper is unwound on a separate device, the register marks in step (B) are produced on the wrapping paper, the wrapping paper marked thereby is wound up and then in step (C), on a further device, the structures are applied to the marked wrapping paper.

28. Method according to claim 1, wherein steps (B) and (C) are carried out on the same device, wherein the device comprises a marking unit which carries out step (B), and comprises a device for the application of the structures in accordance with step (C) and wherein the positions of the register marks and the structures to be applied are synchronized with each other by means of a register control using the register marks detected by a sensor.

29. Method according to claim 1, wherein k is at least −6.5 μm and at most −2.5 μm.

30. Method according to claim 1, wherein said step (B) of generating register marks on the wrapping paper further comprises one or both of a step (B.1) of removing material from the wrapping paper and a step (B.2) of mechanical modification of the wrapping paper.

31. Method according to claim 30, wherein for each of the steps (B.1), (B.2) and (B.3) it holds that, if at all, only substances are added to the wrapping paper which are already present in the wrapping paper in step (A) or which are generated during smoking of a smoking article manufactured from the wrapping paper.

32. Method according to claim 30, wherein at least one opening in the wrapping paper is produced in step (B.1) by die-cutting, perforating or cutting.

33. Method according to claim 32, wherein in the case of perforating or cutting, mechanical perforation or cutting tools or a laser are used.

34. Method according to claim 30, wherein in step (B.1), material is removed from the surface of the wrapping paper so that the transparency of the wrapping paper is increased in this area, but no opening is formed.

35. Method according to claim 30, wherein in step (B.1), register marks are produced, in which the outermost borders in the cross direction have a radius of curvature which is at least 0.1 mm.

36. Method according to claim 30, wherein the wrapping paper is embossed or compressed in step (B.2) such that the transparency of the wrapping paper increases locally.

37. Method according to claim 36, wherein embossing or compressing of the wrapping paper comprises exerting mechanical pressure between two rolls provided with a corresponding pattern, which produce a register mark in the wrapping paper.

38. Method according to claim 36, wherein for the formation of the register marks, the wrapping paper is embossed with a line load which is 70 N/mm to 130 N/mm.

39. Method according to claim 36, wherein embossing is carried out at a higher moisture content of the paper of 5% by weight to 10% by weight with respect to the mass of the wrapping paper.

40. Method according to claim 36, wherein the register marks in step (B.2) are formed during the manufacture of the wrapping paper, wherein the not yet completely finished wrapping paper is locally compressed in the press section or on a wire in the paper machine by means of a cylinder provided with a corresponding pattern.

41. Method according to claim 30, wherein the extension of the register marks which are produced in step (B.1) is at least 0.20 mm and at most 3.00 mm.

* * * * *